US012656095B2

(12) United States Patent
Kruger et al.

(10) Patent No.: US 12,656,095 B2
(45) Date of Patent: Jun. 16, 2026

(54) VELOCITY OF DETONATION MEASUREMENT

(71) Applicant: DETNET SOUTH AFRICA (PTY) LTD, Johannesburg (ZA)

(72) Inventors: Michiel Jacobus Kruger, Johannesburg (ZA); Marinus Yates, Benoni (ZA); Daniel August Julien Louis Maurissens, Johannesburg (ZA); Brian E. Petted, Cedarburg, WI (US)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 89 days.

(21) Appl. No.: 18/572,649

(22) PCT Filed: Jun. 15, 2022

(86) PCT No.: PCT/ZA2022/050024

§ 371 (c)(1),
(2) Date: Dec. 20, 2023

(87) PCT Pub. No.: WO2022/272316

PCT Pub. Date: Dec. 29, 2022

(65) Prior Publication Data

US 2024/0302149 A1 Sep. 12, 2024

(30) Foreign Application Priority Data

Jun. 21, 2021 (ZA) ..... 2021/04220
Jun. 3, 2022 (ZA) ..... 2022/06186

(51) Int. Cl.
*F42D 5/02* (2006.01)
*F42D 1/055* (2006.01)

(52) U.S. Cl.
CPC ..... *F42D 5/02* (2013.01); *F42D 1/055* (2013.01)

(58) Field of Classification Search
CPC ..... F42D 1/00; F42D 1/02; F42D 1/04; F42D 1/042; F42D 1/045; F42D 1/05; F42D 1/055; F42D 65/02
(Continued)

(56) References Cited

U.S. PATENT DOCUMENTS 3,027,751 A * 4/1962 Jones ..... G01N 33/22 73/35.14
3,381,521 A * 5/1968 Caldecourt ..... G01N 25/50 73/35.15
(Continued)

FOREIGN PATENT DOCUMENTS

AU 2017100291 A4 * 4/2017
KR 20160114436 A 10/2016
(Continued)

OTHER PUBLICATIONS

International Preliminary Report on Patentability for Application No. PCT/ZA2022/050024 dated Aug. 18, 2023 (8 pages).
(Continued)

*Primary Examiner* — Troy Chambers
*Assistant Examiner* — Benjamin S Gomberg
(74) *Attorney, Agent, or Firm* — Michael Best & Friedrich LLP

(57) ABSTRACT

A method of obtaining velocity of detonation (VOD) information from a borehole wherein an explosive in the borehole is ignited by initiation of a detonator, the method including the steps of using a control circuit which obtains a measurement of the VOD and which is subsequently destroyed by ignition of the explosive, and of transmitting from the borehole a wireless signal which contains the VOD measurement and data which identifies the borehole before the control circuit is destroyed.

11 Claims, 2 Drawing Sheets

(58) Field of Classification Search
USPC ..... 102/217, 301, 311, 312, 320, 322
See application file for complete search history.

(56) References Cited

U.S. PATENT DOCUMENTS

| | | | | |
|---|---|---|---|---|
| 3,408,855 | A * | 11/1968 | Slykhouse | G01N 25/50 73/35.15 |
| 3,572,095 | A * | 3/1971 | Kowalick | G01N 25/50 73/35.15 |
| 3,852,994 | A * | 12/1974 | Pereda | G01H 5/00 73/35.15 |
| 4,313,380 | A * | 2/1982 | Martner | F42D 3/06 102/317 |
| 4,782,911 | A * | 11/1988 | Dixon | G01V 1/26 367/55 |
| 10,563,967 | B2 * | 2/2020 | Muller | F42D 1/05 |
| 2005/0011389 | A1 | 1/2005 | Teowee et al. | |
| 2005/0247109 | A1 * | 11/2005 | Meyer | F42D 1/05 73/35.15 |
| 2006/0130693 | A1 | 6/2006 | Teowee | |
| 2008/0098921 | A1 | 5/2008 | Labuschagne et al. | |
| 2010/0175574 | A1 | 7/2010 | Nelson et al. | |
| 2013/0098257 | A1 * | 4/2013 | Goodridge | F42B 3/113 102/201 |
| 2014/0311370 | A1 | 10/2014 | Koekemoer et al. | |
| 2015/0075770 | A1 | 3/2015 | Fripp et al. | |
| 2015/0159986 | A1 | 6/2015 | Schlenter | |
| 2016/0046538 | A1 * | 2/2016 | Swanson | C01F 5/04 423/337 |
| 2017/0074625 | A1 | 3/2017 | Appleby et al. | |
| 2017/0074630 | A1 * | 3/2017 | Kotsonis | F42D 1/05 |
| 2020/0309497 | A1 * | 10/2020 | Torrance | F42D 1/055 |
| 2022/0349693 | A1 | 11/2022 | Nielsen et al. | |
| 2023/0296364 | A1 | 9/2023 | Teowee et al. | |

FOREIGN PATENT DOCUMENTS

| | | | |
|---|---|---|---|
| WO | 2006055991 | A1 | 5/2006 |
| WO | 2009025562 | A1 | 2/2009 |
| WO | 2011140549 | A2 | 11/2011 |
| WO | 2014055024 | A1 | 4/2014 |
| WO | 2019071304 | A1 | 4/2019 |

OTHER PUBLICATIONS

International Search Report and Written Opinion for Application No. PCT/ZA2022/050024 dated Sep. 16, 2022 (9 pages).
Annex to International Preliminary Report on Patentability for Application No. PCT/ZA2022/050024 dated Jan. 19, 2023 (7 pages).

* cited by examiner

VELOCITY OF DETONATION MEASUREMENT

CROSS REFERENCE TO RELATED APPLICATIONS

This application is a U.S. National Phase application of International Patent Application No. PCT/ZA2022/050024 filed Jun. 15, 2022 which claims priority to South Africa Patent Application ZA 2021/04220 filed Jun. 21, 2021 and to South Africa Patent Application ZA 2022/06186 filed Jun. 3, 2022, the entire contents of all of which are herein incorporated by reference.

BACKGROUND OF THE INVENTION

This invention relates to a blasting system which makes use of a plurality of detonators and to the measurement of the velocity of detonation ("VOD") of explosives in boreholes which are ignited by the various detonators.

A VOD measurement of an explosive is of value in assessing the effectiveness of a blasting process and can be used for quality control and production control purposes.

To the applicant's knowledge existing VOD measurement techniques are based on the use of a custom-designed instrument which is connected to wires which extend through explosive in a borehole to a detonator. The instrument, which is expensive, is positioned at a location at which it will not be damaged by the effects of blasting. VOD measurement data obtained by the instrument is transmitted to a remote location or otherwise recovered when possible for assessment and processing purposes.

A blast site can include hundreds or thousands of detonators and it is not technically nor financially feasible to make use of a large number of the instruments each of which is associated with a respective explosive-charged borehole.

An object of the present invention is to allow for a VOD measurement of the explosive in each borehole at a blast site, which includes multiple boreholes, to be obtained in a cost effective manner.

SUMMARY OF THE INVENTION

In broad terms the current invention is based on the incorporation, in a communication module which is connected to a detonator, of a capability to make a VOD measurement automatically upon initiation of the detonator and then to transmit the VOD data together with an identifier of the detonator using wireless techniques before the communication module is destroyed by a blasting process which results from initiation of the detonator.

To achieve this objective the invention provides a detonator assembly which includes a communication module which is associated with a borehole into which, in use, an explosive is charged, a detonator which, in use, is positioned inside the borehole exposed to the explosive, and conductors which connect the detonator to the communication module, wherein the detonator in response to a fire command signal received by the detonator at a time A is initiated at a time B thereby to cause ignition of the explosive in the borehole, wherein the detonator assembly includes a control circuit which is configured to obtain a measurement of the velocity of detonation (VOD) of the explosive and a transmitter for transmitting a wireless signal which contains the VOD measurement and identification information which identifies the detonator assembly from which the wireless signal was transmitted before the transmitter is destroyed by the ignited explosive.

The communication module may be positioned at a mouth of the borehole.

Optionally the control circuit is included in the communication module. In that form of the invention the control circuit, in response to receipt of a blast signal from a blast controller, transmits the fire command signal at the time A to the detonator. This can be via the conductors.

In a different form of the invention the fire command signal is transmitted to the detonator from a blast controller using a through-the-earth signal which, preferably, is a magnetic signal.

The identification information may be conveyed, or indicated, in any suitable way, for example through the use of a modulation technique, on the signal, which is uniquely related to the detonator assembly. It is also possible to make use of a technique which links a data packet, which contains the signal, uniquely to the detonator assembly. This could be done by means of a unique coding process embodied in the data packet, by the inclusion of timing signals in the data packet, or in any other way which uniquely associates the data packet with the originating detonator assembly.

In an alternative form of the invention the detonator assembly includes an identifier which uniquely identifies the detonator and the unique identifier is included in the wireless signal which contains the VOD measurement. The unique identifier could be stored in the communication module or in the control circuit or in the detonator.

In a first embodiment of the invention the wireless signal with the VOD measurement is transmitted as data once the VOD measurement has been made but before the detonator is destroyed by the effects of blasting.

In a second embodiment of the invention transmission of the wireless signal commences at the time B and transmission of the signal is maintained until such time as at least a predetermined length of the conductors is consumed by the explosive process. The duration of the time period for which the wireless signal is transmitted is, in itself, indicative of the VOD measurement.

If, for purposes not related to the VOD measurement, a wireless signal ("the first signal") is transmitted by the transmitter at any time after the time A then, to enable the wireless signal which contains the VOD information ("the second signal") to be distinguished from the first signal, the nature of the second signal may be changed to be different from the nature of the first signal. For example prior to initiation at the time B the wireless signal (the first signal) may be modulated in accordance with a first technique but, at the time B, a different modulation technique may be used for the second signal.

The transmission of the first signal, at any time after the time A, is an indication that the detonator assembly is in an effective working state prior to initiation taking place at the time B.

In the aforementioned example the second signal contains the VOD information. As an alternative the duration of the time period between the transmission of the first signal and the transmission of the second signal can constitute or convey the VOD information.

Another variation to the aforementioned process is to transmit the first signal at a first frequency and to transmit the second signal at a second frequency so that the signals are distinguishable from each other.

Thus, in contrast to the established prior art approach, a VOD measurement is made using a measuring and computing capability in the control circuit which is embodied in the wireless detonator assembly. The relevant measurement data is transmitted wirelessly to a remote point. This approach allows for a VOD measurement to be made for the explosive in each borehole.

In one approach the wireless signal is transmitted for the duration of the time period it takes for a predetermined length of the conductors, e.g. between the communication module and the detonator, to be consumed by the explosive. The predetermined length of the conductors would normally be less than the complete length of the conductors i.e. up to the detonator (depending on the depth of the borehole). This is because a time interval of sufficient duration is required before the sending of the signal—this must occur prior to initiation of the detonator, an event which destroys communication capabilities. The length of the conductors inside the explosive extending from the communication module to the detonator is known, beforehand, from a blast plan for the blast site. Upon initiation of the explosive a plasma is generated. The plasma is conductive and acts as a short circuit between the conductors, exposed to the plasma, which extend from the communication module to the detonator. The value of the resistance which is presented by these conductors to the control circuit decreases as the plasma forms a conductive path between the conductors. The value of the resistance measurement, which changes, is indicative of the length of the conductors consumed during the initiation process.

Any other appropriate technique could be used for determining the length of the conductors in the borehole.

An instantaneous rate at which the value of the resistance decreases is also indicative of the VOD of the explosive material.

In a variation of the aforementioned technique use is made of an oscillator in which the resistance between the conductors comprises a parameter the value of which is reflected in the frequency of operation of the oscillator. Thus as the value of the resistance presented by the conductors to the control circuit changes the frequency of oscillation of the oscillator also changes. It is then possible to measure the rate of change of the frequency to obtain a VOD measurement.

A typical blasting system includes a large number of boreholes each of which respectively contains an explosive material and a detonator assembly which, upon actuation, initiates the explosive material in a controlled manner. Preferably each detonator assembly includes an identifier which uniquely identifies the detonator assembly. Information on the identifier is included in the wireless signal which is transmitted by the detonator assembly. As noted though information on the detonator identifier can be transmitted using other techniques.

In a blasting system which includes hundreds or thousands of detonators which are fired within seconds of one another it is essential to be able to distinguish a wireless signal transmitted from a first detonator assembly from a wireless signal transmitted essentially simultaneously from a second detonator assembly.

To achieve this objective the wireless signals which are transmitted by the respective transmitters may be orthogonal; a feature which allows the signals to be distinguished from one another irrespective of the fact that one wireless signal may overlap in time with another wireless signal or with a number of the wireless signals.

As a practical feature to assist in a discrimination exercise of the aforementioned kind the time interval during which each transmitter transmits the wireless signal referred to is reduced to a minimum. This helps to reduce interference between the signals. The time interval is however of sufficient duration to enable the information on the VOD measurement to be included in the transmitted wireless signal and, where required, for the VOD to be measured. Various modulation techniques can be employed in this regard e.g. amplitude modulation, frequency modulation, phase modulation, spread spectrum modulation and chirp modulation.

In one approach to enable wireless signals which are close to one another in time and which possibly overlap with one another to be distinguished, a first frequency spectrum is assigned to a first detonator assembly and a second frequency spectrum, which is distinguishable from the first frequency spectrum, is assigned to a second detonator assembly. This exercise can be repeated as appropriate.

The aforementioned approach may be adopted for detonator assemblies which are fired in the same time slot. In respect of detonator assemblies which are fired in different time slots it is also possible to allocate the first frequency spectrum and the second frequency spectrum etc. to those detonator assemblies which otherwise could give rise to the problem which has been described. Thus those detonator assemblies which are fired in a first time slot and which are physically close to each other so that the respective wireless signals with the VOD measurements cannot readily be distinguished from one another may be allocated respective distinct frequency spectrums or, as noted, different modulation techniques may be employed for the wireless signals.

Similarly those detonators which are fired in a second time slot which is different from the first time slot may be allocated respective frequency spectrums. These may be the same as the frequency spectrums used in the first time slot.

In a general sense various modulation techniques may be employed in order to distinguish wireless signals which are transmitted at the same time or in the same time interval. The use of orthogonal signals can be adopted. Broadly stated orthogonal signals are those signals (two or more) which occupy the same time domain but which do not interfere with each other and which remain distinguishable from each other.

The wireless signals can be modulated in a manner which promotes multiplexing of simultaneously transmitted signals from the detonator assemblies that overlap in time in accordance with a blast plan delay profile. These multiplexing methods can include, but are not limited to, time-, frequency-, and amplitude-modulation and phase shifting of the signals.

The multiplexing method which is adopted can be used to identify specific events in a detonator blast cycle. For example it is possible to shift the phase of a wireless signal from a detonator assembly in response to an ignition event at the detonator assembly. The shifted phase signal could also carry time information which is indicative of the VOD measurement of the explosive in the blast hole. In this approach the phase shift of the signal would be such that a receiver, detecting the phase shifted signal, would be able to identify the time of the event referred to. The duration of the orthogonal signal could be used to indicate the VOD measurement based on the time to consume a predetermined length of the conductors by the explosive process.

For exemplary purposes only, if the VOD measurement in each borehole assembly is based on the time taken to consume 10 meters of the conductors in the borehole then the measured time would be directly related to the respective VOD measurement.

Another benefit is that the aforementioned technique makes it possible to allow for multiple or successive VOD measurements to be taken during an event. In this process the VOD measurement is calculated in a dynamic manner and the wireless signal, transmitted from the detonator assembly, adapts or changes as the VOD measurement changes. For example, the conductors in the borehole can be notionally separated into a succession of predetermined lengths e.g. each 3 meters long. For each predetermined length a corresponding VOD measurement is taken. The wireless signal which is transmitted at any time then reflects the current or latest VOD measurement. The wireless signal can then be adapted or changed using any of the aforementioned techniques e.g. by using a time-, frequency- or amplitude-modulation technique or a phase shifting approach. This method can continue for a predetermined length of the conductors or until such time as the detonator assembly has been consumed i.e. destroyed by the blast process.

The invention further extends to a blasting system which includes a blast controller, a plurality of boreholes at a blast site, each borehole being charged with explosive material, a plurality of detonator assemblies respectively associated with said plurality of boreholes, each detonator assembly including a communication module which is associated with a respective borehole, a detonator which in use is positioned inside the borehole exposed to the explosive material, and conductors which connect the detonator to the communication module, wherein the communication module includes a control circuit which in response to receipt of a blast signal from the blast controller transmits a fire command signal via the conductors to the detonator thereby to cause initiation of the detonator and subsequent ignition of the explosive material, the control circuit being configured to carry out a velocity of detonation (VOD) measurement of the explosive material, and a transmitter for transmitting a wireless signal which contains the VOD measurement and an identifier for the detonator assembly before destruction of the transmitter by the ignited explosive material, and wherein at least those wireless signals which are transmitted simultaneously or in identical time slots by said transmitters from said plurality of detonator assemblies are multiplexed to enable such signals to be distinguished from one another.

These multiplexing methods can include but are not limited to, time, frequency and amplitude modulation and phase shifting of the signals.

A unique identifier may be stored in memory in the detonator or in the communication module, and the wireless signal may include the identifier.

The multiplexing methods which are employed can also be used to identify and report specific information, such as a VOD measurement, in a detonator blast cycle. For example at the time of an ignition event the amplitude of the detonator assembly signal would be gated off for a set period of time. The signal amplitude would be gated on after a specific period of time to allow a receiver to determine the ignition event accurately. By combining the duration of the fixed gated off signal and the duration of the gated on signal the VOD measurement can be determined for a predetermined length of conductor consumption by the explosive.

In one form of the invention orthogonality of the respective wireless signals may be achieved by the use of different modulation techniques e.g. amplitude modulation, frequency modulation, phase modulation, spread spectrum modulation and chirp modulation processes.

Additionally, to assist in discrimination as aforesaid, the duration of each time slot may be kept to a minimum in order to reduce interference between wireless signals from different detonator assemblies.

The identification of the wireless signals that overlap in time can be done because, besides the different times of transmission and different frequencies employed in the respective wireless signals, use is made of techniques which allow for the respective wireless signals to be distinguished from one another.

Each wireless signal contains an identifier, or otherwise conveys information, which uniquely identifies the detonator assembly from which the wireless signal originated. Each borehole is also uniquely distinguishable from other boreholes using any appropriate system e.g. a geographic identification system, a borehole numbering system or the like. That information which is directly linked to the unique identifier of the detonator assembly located in the borehole allows for the VOD measurement for the explosive in each borehole to be unambiguously associated with that borehole.

The invention also provides a method of obtaining velocity of detonation (VOD) information from a borehole wherein an explosive in the borehole is ignited by initiation of a detonator the method including the steps of using a control circuit which obtains a measurement of the VOD and which is subsequently destroyed by ignition of the explosive, and of transmitting from the borehole a wireless signal which contains the VOD measurement and data which identifies the borehole before the control circuit is destroyed.

BRIEF DESCRIPTION OF THE DRAWINGS

The invention is further described by way of examples with reference to the accompanying drawings in which.

DESCRIPTION OF PREFERRED EMBODIMENTS

Figure 1:
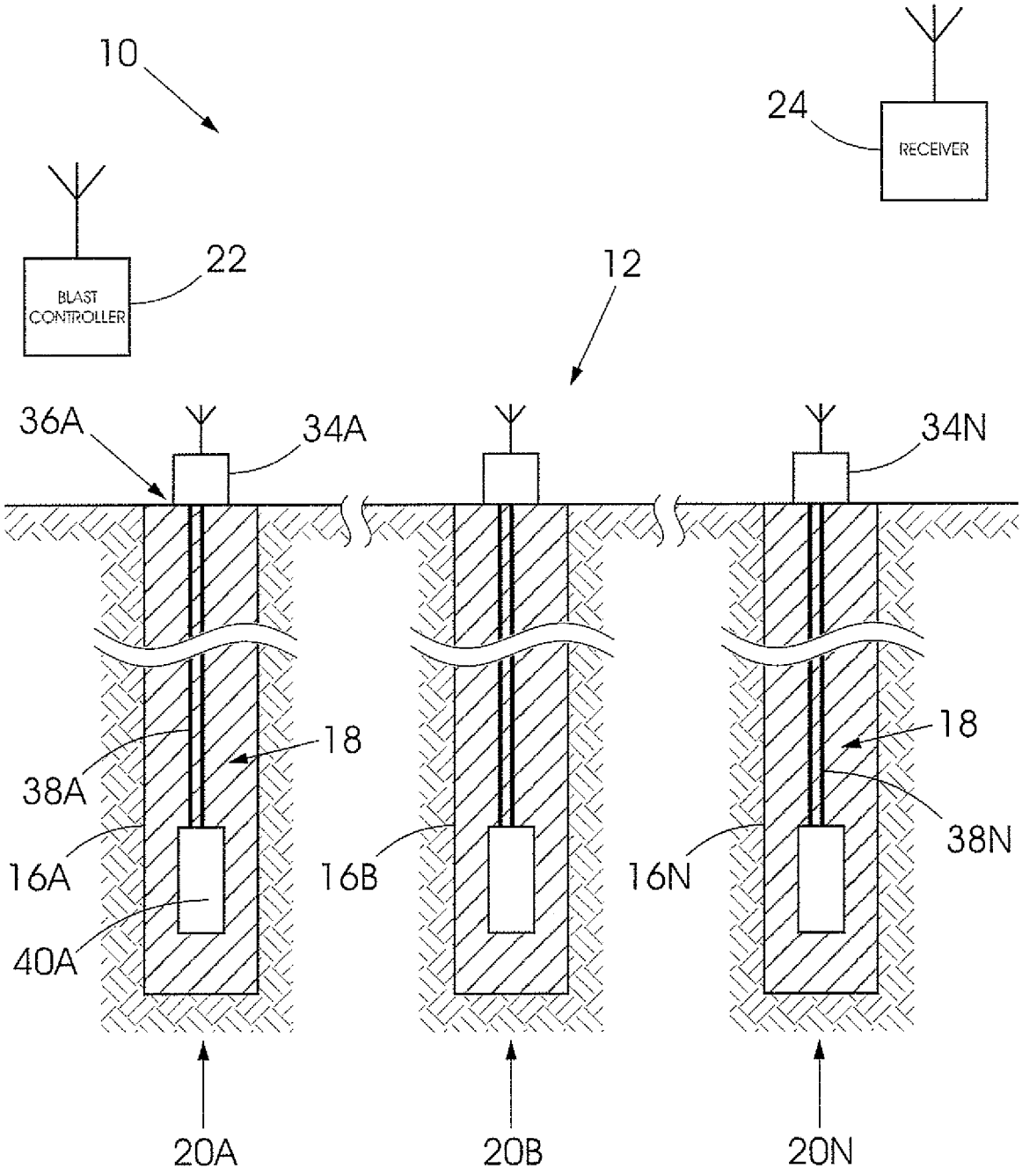
FIG. 1 illustrates aspects of a blasting system according to the invention.

FIG. 1 of the accompanying drawings schematically illustrates aspects of a blasting system 10 at which the principles of the invention are implemented.

The blasting system 10 includes a blast site 12 at which are formed a plurality of boreholes 16A, 16B . . . 16N at predetermined locations. Each borehole is charged with an explosive 18, as is known in the art.

The blasting system 10 includes a plurality of detonator assemblies 20A, 20B . . . 20N. Each detonator assembly is located in a respective borehole 16 exposed to the explosive 18 in the borehole.

The blasting system 10 includes a blast controller 22 and a receiver 24. The receiver 24 may be one of a number of similar receivers which are positioned at predetermined remote locations around the blast site 12. Alternatively the receiver 24 is located at, or forms a part of, the blasting controller 22. Another possibility is to configure one or more detonator assemblies 20, selected for the purpose, so that each can then act, at least to the extent required for the implementation of the invention, as a receiver 24.

The detonator assemblies 20 are physically substantially identical to one another although the operations thereof are not necessarily identical.

Referring to the detonator assembly 20A it includes a communication module 34A which is configured to be positioned at a mouth 36A of the borehole 16A in which it is positioned. The communication module 34A is connected by conductors 38A to a detonator 40A which is positioned in accordance with a blast plan for the blasting system 10 at a known depth in the borehole, exposed to the explosive material 18.

Figure 2:
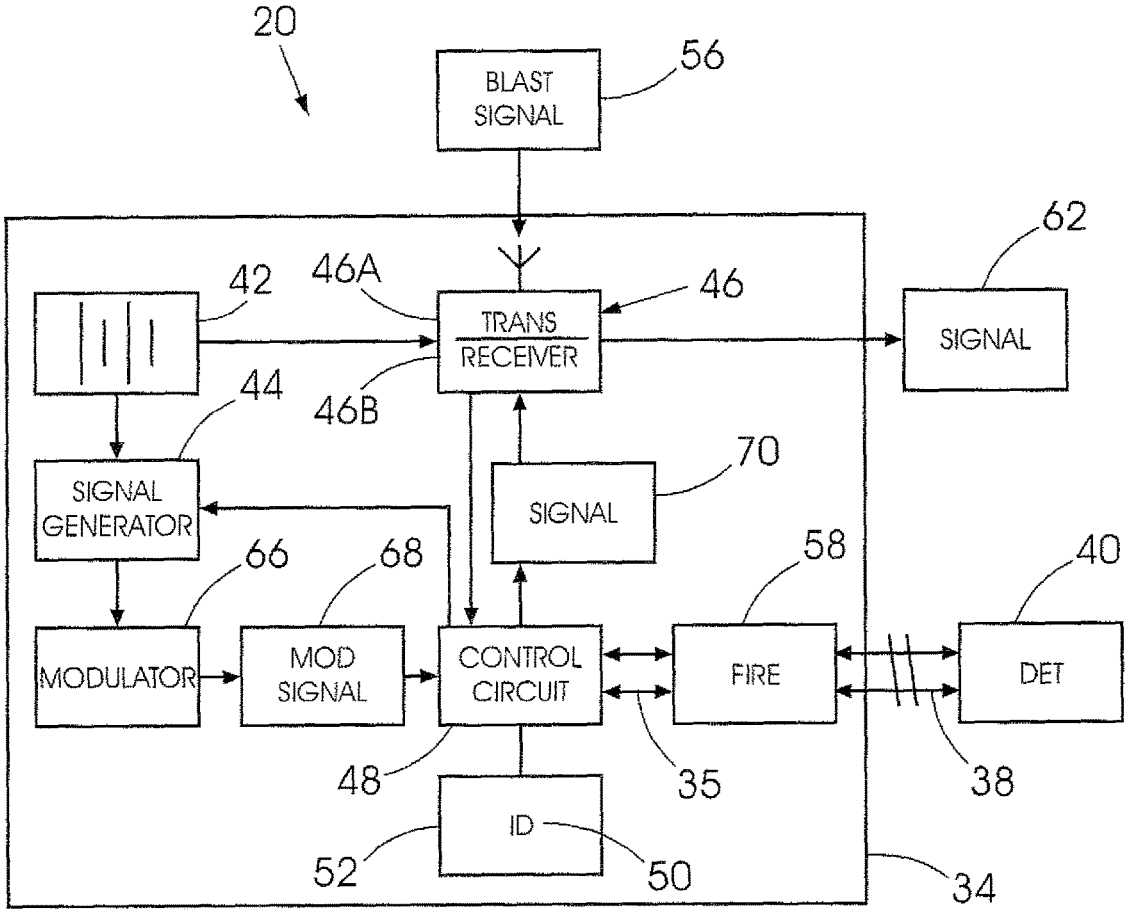
FIG. 2 illustrates in block diagram form some components of a detonator assembly according to the invention.

FIG. 2 shows in block diagram form a detonator assembly 20.

The communication module 34 includes a power source 42, a signal generator 44, a transmitter/receiver module 46 with a transmitter 46A and a receiver 46B, and a control circuit 48. The listing of these components is not exhaustive and is given to enable the principles of the invention to be understood. In one embodiment an identifier 50 which uniquely identifies the detonator assembly 20 is stored in a memory unit 52 in the communication module 34.

The blast controller 22 is used to execute a blasting sequence in the blasting system according to predefined protocols. After all prescribed initial checking and programming steps have been taken a stage is reached at which the blast controller 22 transmits a blast signal 56 to the various detonator assemblies 20A . . . 20N. The blast signal 56 is received by the receiver 46B and validated by the control circuit 48 and, in accordance with predetermined rules, the control circuit 48 then transmits a fire command signal 58 via the conductors 38 to the detonator 40. The fire signal 58 causes the detonator 40 to initiate at a predetermined time and the explosive 18 exposed to the detonator is ignited.

Subsequently, as is described hereinafter, a wireless signal 62, which contains a VOD measurement of the explosive 18, is sent to the receiver 24.

The length of the conductors 38 between the communication module and the detonator 40 is known. From that value, and from the time which is taken for the conductors to be consumed, the VOD for the explosive exposed to the conductors can be determined.

The wireless signal 62 also includes the identifier 50 which uniquely identifies the detonator assembly 20. Additionally, the identifier 50 is linked to an identifier of the borehole 16 at which the detonator assembly 20 is used. The borehole 16 can be numerically designated or it can be designated by means of its geographical position i.e. through the use of appropriate coordinates. That information is kept in a database which is accessible by a control computer, not shown, linked in any suitable way to the blast controller 22 and to the receiver 24.

The wireless signal 62 is produced in a controlled manner by the function of the control circuit 48 which actuates the signal generator 44. A signal produced by the signal generator is subjected to a modulation technique by a modulator 66, as is described hereinafter. The resulting modulated signal 68 is applied to the control circuit 48 and combined with the identifier 50 to produce a signal 70 which then, via the transmitter 46A, is included in the wireless signal 62 which is transmitted from the detonator assembly.

In a variation the modulation technique used for the transmission of the VOD signal can be configured so that it uniquely identifies the originating detonator assembly.

At a blast site which includes a large number of boreholes and detonator assemblies, of the order of several thousand, technical challenges arise in distinguishing a wireless signal 62X sent from a detonator assembly 20X from a wireless signal 62Y sent from a detonator assembly 20Y. The difficulty is compounded when the respective wireless signals, possibly from a large number of detonator assemblies, are sent simultaneously or substantially simultaneously i.e. with only a very small time interval between the actual transmission times of the wireless signals.

Despite this difficulty the transmission of a wireless signal from a detonator which contains a VOD measurement of the explosive exposed to the detonator is of significant value in forming an assessment of blasting efficiency and for quality control purposes.

Figure 3:
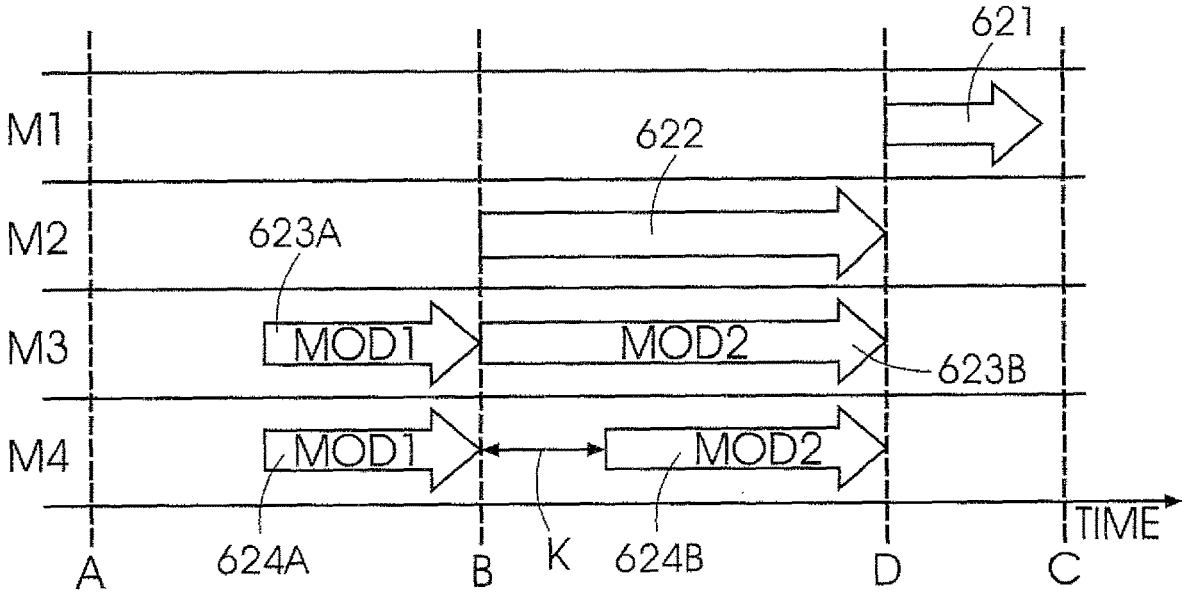
FIG. 3 is a graphical depiction of different inventive techniques upon which the generation and transmission of VOD measurements from detonator assemblies in the blasting system can be based.

FIG. 3 graphically depicts different methods for generating and transmitting a wireless signal which contains data relating to a VOD measurement. Inherently there are time constraints in measuring the VOD which can be as high as 7000 mps. By way of a non-limiting example only, and depending inter alia on measurement techniques employed, in order to measure this parameter an explosive front in the borehole under consideration should travel for at least 10 meters so that there is sufficient time to make, and then to process, relevant input data. This means that it would take about 1.5 milliseconds to gather the information required to provide a VOD calculation. The control circuit 48 can then calculate the velocity of detonation and include the VOD value and the identifier 50 in the signal 70. That information is then transmitted in the wireless signal 62.

FIG. 3 shows a horizontally extending timeline with spaced apart transversely extending dotted lines marked A, B, C and D respectively. In respect of any given detonator assembly 20 the time A is the time at which the fire command signal 58 is sent by the control circuit 48 via the conductors 38 to and received by the associated detonator 40.

The time B is the time at which the detonator 40 is initiated and consumed (destroyed) in response to the fire command signal 58.

The time C is the time at which the communication module 34 has been consumed after ignition of the explosive 18.

The time D is a parameter used to mark the end of a time interval after the time B during which time interval a predetermined length of the conductor 38 has been consumed and which time interval is of sufficient duration to enable a VOD measurement to be made.

In a first method M1 the transmitter 46A is kept inoperative until such time as VOD data has been obtained. At the time D a signal 621 with the VOD data and the identifier 50 is transmitted by the transmitter 46B. Clearly this must be before the time C for at the time C the detonator assembly 20 is destroyed by the ignited explosive 18.

In a second method M2 transmission of a wireless signal 622 commences at the time B and ends at the time D. The VOD measurement, once calculated, is included with the identifier in the wireless signal 622. This is not necessarily the case for the VOD measurement could be obtained from the expression (length of conductor 38 consumed)/(duration of signal). Thus if the length of the conductor is a known quantity the duration of the signal is sufficient to convey the VOD data. No additional data is required to be sent during the transmission although data such as an identifier for the detonator assembly could be sent.

In a method M3 transmission of a first signal 623A commences at or after the time A but before the time B. Transmission of the signal 623A ends at the time B. Thereafter a second signal 623B is transmitted from the time B up to the time D at which time the measurement of the VOD has been completed and this measurement and the identifier are then included in the signal 623B.

The signals 623A and 623B can be distinguished from each other through the use of an appropriate modulation technique (MOD1, MOD2). For example the signal 623A may comprise an up-chirp signal while the signal 623B may comprise a down-chirp signal which is modulated with the VOD and identifier information. The signals 623A and 623B can be distinguished from each other in any other suitable way e.g. by using different frequencies for their transmissions.

FIG. 3 thus graphically depicts different ways in which a wireless signal can be transmitted from a detonator assembly to transfer information relating to the VOD measurement and the respective identifier. The VOD measurements for each of the explosive charges in the respective boreholes are transferred to a control location for subsequent assessment and processing.

In a large blasting system with several thousand detonators the VOD signals coming from the various detonator assemblies must be distinguished from one another even though at least some of such signals may be transmitted at the same time or within closely spaced time intervals from one another. To achieve this type of discrimination the wireless signals 62 coming from the different detonator assemblies are orthogonal or multiplexed using various techniques. Use is made of orthogonal frequency division multiplexing techniques as referred to hereinbefore.

In the method M1 the VOD data is transmitted in the signal 621 only after a full calculation has been made thereof.

In the method M2 the signal 622 is transmitted from the time B and it is transmitted continuously while the conductors 38 are being consumed. Once the conductors are fully consumed, or after consumption of a predetermined length of the conductors, transmission of the signal 622 is terminated. Thus the duration of the time period for which the signal 622 is transmitted is, in itself, indicative of the VOD, for the lengths of the conductors from the module 34 to the detonator 40 are known.

In the method M3 a first signal 623A is transmitted for other communication purposes not related to the VOD measurement, up to the time B. Thereafter a signal 623B is transmitted. This signal essentially corresponds to the signal 622 in that it endures for a period from the time B until such time as the conductors 38 have been consumed. The signals prior to the time B and after the time B are differentiated from one another to avoid confusion and to enhance discrimination, by transmitting the signals at different frequencies or by using different modulation techniques on the signals. In each case the transmitted signal 62 does carry the unique identifier for the detonator assembly in question.

A technique which finds particular value in measuring VOD is to measure the rate of change of a parameter which is dependent on VOD.

While the conductors 38 are being consumed it is possible to calculate the instantaneous rate at which this occurs. One approach is to measure the resistance presented by the conductors 38 to the control circuit 48. This resistance changes as plasma resulting from initiation of the explosive 18 creates a conductive path between the conductors 38. The rate at which the resistance changes, due to the plasma effect, is then indicative of the VOD. An instantaneous rate of change of resistance value can be obtained in a shorter period than the period which is taken for the conductors from the module 34 to the detonator 40, or a predetermined length of these conductors, to be consumed.

The resistance which is presented by the conductors 38 could alternatively be regarded as being linked to a resistor which is included as an active element in an oscillating circuit e.g. an L/R/C circuit in which the frequency of oscillation is dependent at least on the value of the resistance. As the resistance changes, in the manner described, the frequency of oscillation also changes. The instantaneous rate at which the frequency changes is indicative of the VOD and a signal containing data on the rate of change of the frequency, collected at a remote point, enables the VOD data for the particular borehole to be logged. A similar result can be achieved by monitoring the amplitude of oscillation (not the frequency of oscillation), and the rate of change of the amplitude.

FIG. 3 shows a method M4 which is similar to M3. Transmission of a first signal 624A commences at or after time A and is continued up to the time B. Thereafter signal transmission is stopped, i.e. there is radio silence, for a time interval K of duration which is less than (B-D). At the end of the time interval K transmission of a second signal 624B commences and continues until the time D i.e. after a velocity of detonation measurement has been made, or after a predetermined set time which ends before the time C. The signals 624A and 624B do not necessarily have to be distinguished from each other in that the receiver 24 associated with the blast controller 22 has the capability to detect the stop-start in the transmission i.e. the stopping of the transmission of the signal 624A at the time B and the starting of the transmission of the signal 624B at the time B+K.

The invention claimed is:

1. A blasting system comprising: a plurality of detonator assemblies, a blast controller and at least one receiver, wherein each detonator assembly includes a detonator which, in use, is positioned inside a borehole which is charged with an explosive, a communication module and conductors which connect the detonator to the communication module, wherein the detonator in response to a fire command signal from the blast controller received by the detonator at a time A is initiated at a time B to cause ignition of the explosive in the borehole, and wherein the communication module includes a control circuit which is configured to obtain a measurement of the velocity of detonation (VOD) of the explosive which is based on a resistance value which is presented by the conductors to the control circuit, and which is indicative of a predetermined length of the conductors consumed by the ignited explosive and a transmitter for transmitting to the receiver a wireless signal which commences at the time B and is maintained for a time period until the predetermined length of the conductors is consumed by the ignited explosive, and wherein the time period for which the wireless signal is transmitted is indicative of the VOD measurement and is reduced to a minimum to assist in discriminating between the wireless signal and respective wireless signals transmitted from other detonator assemblies of the plurality of detonator assemblies, and wherein the wireless signal contains identification information which identifies the detonator assembly from which the wireless signal was transmitted before the transmitter is destroyed by the ignited explosive.

2. A blasting system according to claim 1 wherein the control circuit, in response to receipt of the fire command signal from the blast controller, transmits the fire command signal at the time A to the detonator.

3. A blasting system according to claim 1 wherein the fire command signal is transmitted to the detonator from the blast controller using a through-the-earth signal.

4. A blasting system according to claim 1 wherein the identification information comprises at least one of: a modulation technique, on the wireless signal, which is uniquely related to the detonator assembly; a data packet which contains the wireless signal and which is uniquely linked to the detonator assembly; and a unique identifier, in the wireless signal, of the detonator assembly.

5. A blasting system according to claim 1 wherein said respective wireless signals are transmitted simultaneously or in a first time slot by said transmitters from said plurality of detonator assemblies and are multiplexed to enable the respective wireless signals to be distinguished from one another.

6. A blasting system according to claim 5 wherein the respective wireless signals which are transmitted in a second time slot, which is different from the first time slot, are modulated so that the frequency spectrums of the respective wireless signals transmitted in the second time slot are the same as the frequency spectrums of the respective wireless signals transmitted in the first time slot.

7. A blasting system according to claim 1 wherein the communication module is configured to change the nature of another wireless signal which is sent from the communication module and which is indicative of the detonator assembly being in an effective working order from the nature of the wireless signal which contains the VOD measurement.

8. A blasting system according to claim 1 wherein the conductors are separated into a succession of the predetermined lengths to allow determination of respective VOD measurements which are associated with the predetermined lengths, and wherein the communication module is configured such that an amplitude of the wireless signal during respective time periods which are associated with the predetermined lengths is gated on and off successively.

9. A blasting system according to claim 1 wherein the borehole is uniquely distinguishable from other boreholes which, together with the identification information allows the VOD measurement to be associated with the borehole from which the VOD measurement was taken.

10. A method of obtaining velocity of detonation (VOD) information from each of a plurality of boreholes in a blasting system which comprises a plurality of detonator assemblies, a blast controller and at least one receiver, wherein each detonator assembly includes a detonator which, in use, is positioned inside a respective borehole of the plurality of boreholes, a communication module and conductors which connect the detonator to the communication module which includes a control circuit, wherein each borehole is respectively charged with an explosive which is ignited by initiation of the respective detonator in the borehole at a time B in response to a fire command signal from the blast controller received by the detonator at a time A, the method comprising the steps, at each borehole, of: using the respective control circuit which is associated with the respective detonator to obtain a measurement of the VOD of the explosive which is based on a resistance value which is presented by the conductors to the control circuit, and which is indicative of a predetermined length of the conductors consumed by the ignited explosive; and transmitting from the borehole to the receiver a respective wireless signal which commences at the time B and is maintained for a time period until the predetermined length of the conductors is consumed by the ignited explosive, and wherein the time period for which the wireless signal is transmitted is indicative of the VOD measurement and is reduced to a minimum to assist in discriminating between the wireless signal and respective wireless signals transmitted from other detonator assemblies of the plurality of detonator assemblies and wherein the wireless signal contains data which identifies the borehole.

11. A method according to claim 10 wherein said wireless signal is modulated to enable the wireless signal to be distinguished from any other wireless signal which contains a VOD measurement and which is simultaneously transmitted.

* * * * *